United States Patent [19]

Anderle et al.

[11] Patent Number: 4,476,909

[45] Date of Patent: Oct. 16, 1984

[54] CORD LOCK FOR A VENETIAN BLIND LIFT CORD

[75] Inventors: Joseph A. Anderle, Clifton, N.J.; Victor Debs, Staten Island, N.Y.

[73] Assignee: Levolor Lorentzen, Inc., Lyndhurst, N.J.

[21] Appl. No.: 388,158

[22] Filed: Jun. 14, 1982

[51] Int. Cl.[3] ..... E06B 9/324

[52] U.S. Cl. ..... 160/178 C

[58] Field of Search ..... 160/178 C, 173, 178 B

[56] References Cited

U.S. PATENT DOCUMENTS

| | | | |
|---|---|---|---|
| 691,603 | 1/1902 | Covency | 160/173 |
| 2,056,154 | 10/1936 | Benson | 24/132 R |
| 2,449,583 | 9/1948 | Burns | 160/173 |
| 4,180,118 | 12/1979 | Vecchiarelli | 160/178 C |
| 4,352,386 | 10/1982 | Butler et al. | 160/178 C |

FOREIGN PATENT DOCUMENTS

| | | | |
|---|---|---|---|
| 0059807 | 3/1981 | European Pat. Off. | 160/178 C |

*Primary Examiner*—Peter M. Caun

*Assistant Examiner*—Cherney S. Lieberman

[57] ABSTRACT

A cord lock for a venetian blind lift cord; having a housing with two side walls in spaced, substantially parallel relationship to each other, each side wall being provided with an oblong window with the windows in alignment with each other. A cam extends in the housing through the windows and is slidably and non-removably received in the windows. Each side wall also is provided with an elongated slot extending essentially vertically and at an angle with respect to the window, the slots being in alignment with each other. A cord glide body is non-rotatably but slidably received in the slots. The cord lock enables a lift cord passed in the housing over the cord glide body and between the cord glide body and the cam to be releasably locked therebetween.

6 Claims, 7 Drawing Figures

CORD LOCK FOR A VENETIAN BLIND LIFT CORD

BACKGROUND OF THE INVENTION

The present invention relates to a cord lock for a venetian blind lift cord.

Different forms of such cord lock are known in the art. One example known to the Applicants has a cord lock housing in which is rotatably mounted a pulley made from a plastic material, and a knurled rivet which can move up and down in slots in the housing. The lift cord for lifting and lowering the slots of the blind passes between the pulley and the rivet. When the lift cord is to be locked in position the rivet engaged by the cord travels upwardly, caused by the weight of the blind, and the cord becomes wedged between the rivet and the pulley. When the cord is pulled downwardly, the rivet drops and the blind is released. Experience has shown that such cord locks have a serious defect because of the plastic pulley. The cord used in venetian blinds is abrasive and wears grooves into the plastic pulley. As a consequence, the pulley does not rotate and the cord wears deeper and deeper grooves so that the cord eventually is no longer in the proper position relative to the rivet or cam locking the lift cord together with the pulley. As a result the lift cord cannot be locked. There may be other reasons for the failure of the pulley, such as that there is a slight flash of plastic molded onto the pulley and this flash fills the normal clearance and jams the pulley so that it cannot rotate. Any foreign matter, such as sawdust or plastic or metal chips, becomes wedged in the clearance between the pulley and the housing of the cord lock, and prevents the rotation of the pulley.

Furthermore, the pulley may freeze at the walls of the cord lock housing. Failure results quickly because the frozen pulley will be heated by the friction generated by the lift cord rubbing against the pulley and this will warm and soften or melt the plastic of the pulley.

Replacing the plastic pulley by a metal one also has serious disadvantages. The pulley will squeal and because the cord lock is mounted in metal head rail the squeal will be amplified.

Using a miniature precision ball bearing to insure rotation of the pulley would be prohibitive because of cost.

It is an object of the present invention to overcome the various problems mentioned above caused by non-rotation of the pulley in the cord lock.

It is another object of the present invention to provide a cord lock that is simple in construction, and that can be manufactured easily and at low cost.

BRIEF SUMMARY OF THE INVENTION

The solution provided by the present invention consists in replacing the rotatable pulley, whether of metal or plastic, by a non-rotatable cord glide body with a smooth surface causing minimum friction and wear of the cord.

The cord glide body is designed such that it can easily be arranged in the cord lock housing.

BRIEF DESCRIPTION OF THE DRAWING

The invention is illustrated by way of example, in the accompanying drawings, in which.

DETAILED DESCRIPTION OF A PREFERRED EMBODIMENT

Figure 2:
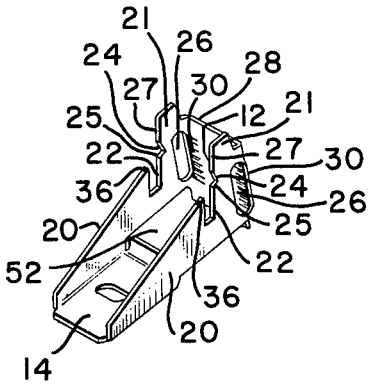
FIG. 2 is a perspective view of the cord lock housing from above, prior to insertion of the cord glide body and cam into the housing.
Figure 6:
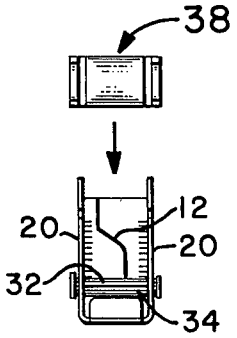
FIG. 6 is a front view of the cord lock, prior to insertion of the cord glide body into the housing.
Figure 3:
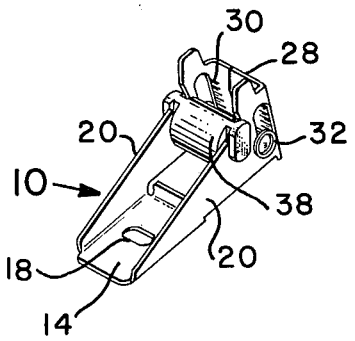
FIG. 3 is a perspective view of the cord lock upon insertion of the cord glide body and cam into the housing.
Figure 7:
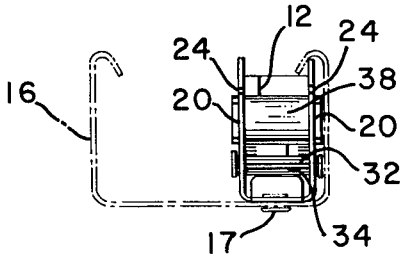
FIG. 7 is a front view of the cord lock after insertion of the cord glide body.

Referring now to the drawings in detail, the cord lock according to the present invention comprises a cord lock housing which is generally designated with the reference numeral 10 and which is stamped out from an integral piece of metal, with a zig-zag parting line indicated at 12 in FIGS. 2, 6 and 7. The housing has a base 14 which can be connected to the head channel of a venetian blind, which is indicated in dot-dash lines in FIG. 7 and carries reference numeral 16, by passing a screw or rivet 17 through a hole 18 in base 14 and a similar opening in the head channel. The housing also has two opposite and identical side walls 20, each extending upwardly roughly in the form of a triangle, from the base 14, but with an extension 21.

Each side wall 20 is provided with a substantially vertically extending slot 22, an essentially triangular notch 24 and an essentially oval window 26 extending at an acute angle with respect to the slot 22 and with respect to the base 14. The corners 36 located opposite notches 24 are slightly rounded. The housing finally comprises an end wall 28 having the above mentioned parting line 12. The inside of the end wall 28 is provided with serrations or shallow grooves 30 adjacent each window 26. A cam or rivet 32 is slidably received in windows 26 and has a width in excess of the width of the housing while the ends of the cam are wider than the window so as to prevent the cam from falling out of the housing. The cam is knurled by providing it with longitudinal grooves 34.

Figure 4:
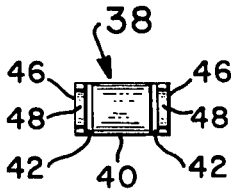
FIG. 4 is a front view of the cord glide body.
Figure 5:
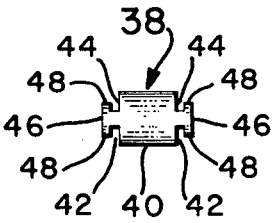
FIG. 5 is a top view of the cord glide body (turned by 90° with respect to FIG. 4)

The cord lock according to the present invention also comprises a cord glide body 38 (FIGS. 4 and 5). It has a cylindrical central portion 40 into which opposite grooves 42 and 44 have been cut of a width slightly larger than the thickness of the housing walls 20. The cord glide body 38 also has two end portions 46 each having parallel, flat side faces 48 extending parallel to slots 22 while the remaining part is rounded, with the same diameter as the central portion 40. The flat side faces 48 prevent interference with the upward movement of the cam 32 in windows 26.

The cord lock is assembled by placing the cord glide body 38, by hand or machine, in the area of the notches 24 and rounded corners 36 with the central portion 40 between side walls 20. The notches facilitate the placement of the cord glide body, because lower surfaces 25 defining part of the notches 24 together with the rounded corners 36 form a ledge about which the cord glide body can swing upwardly and backwardly until it comes to rest against and it is guided by essentially vertically extending edges 27 of the housing side walls, whereupon the glide body can be pressed deep into the slots 22. Thus placed, the cord glide body is prevented from rotating.

Figure 1:
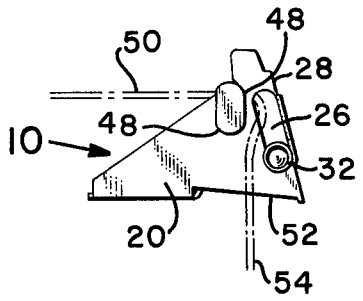
FIG. 1 is a side view of the cord lock according to the present invention.

In the final assembly, i.e. when the lock is installed in the venetian blind head, a lift cord 50 passes over the upper portion of the cord glide body 38 thereby positively preventing escape of the glide body from the housing. The cord then passes inside the housing in front of the cam 32, i.e. on that side of the cam which is remote from the end wall 28. Thereafter, the lift cord passes through an opening 52 in the cord lock housing and a similar opening (not shown) in head channel 16. It will be appreciated that when locking the lift cord in position the lower portion 54 of the lift cord is pulled against the grooves 34 of the cam 32 and upon releasing the cord it together with the cam 32 will ride upwardly due to the weight of the blind, until the lift cord becomes locked between the cam and the cord glide body 38 to thereby lock the lift cord in position. When the position of the blind is to be changed the lower cord portion 54 is pulled to the left (in FIG. 1) and downwardly whereupon cam 32 drops thus creating sufficient space between cam 32 and glide body 38 to permit free movement of cord 50.

The glide body is preferably made of a formulation of zinc, such as Zamak 3, and is then nickel plated to prevent discoloration of the lift cord. Even if the zinc should mark the cord the marks will convert to zinc oxide and will usually not be visible.

The cord glide body 38 also performs another important function. As will be evident from FIG. 7 end portion 46 serves as a stop engaging the side of head channel 16. It thus fixes the position of cord lock 10 in conjunction with rivet 17. The length of end portion 46 is such that there remains sufficient space between side wall 20 of the cord lock housing and the side wall 16 of the head channel for the cam 32 to move freely. It thus eliminates the need for an extra stop, such as a lancing or the like on side wall 20.

It is, of course, to be understood that several modifications are possible without affecting the scope of the invention. Thus, for instance, the cam or rivet cooperating with the glide body may take a form different from that shown here and its arrangement within the cord lock body may be different. Also, there may be instances where the glide body in the housing is merely used for changing the direction of the lift cord, that is where there is no cam for locking the cord in cooperation with the glide body.

We claim:

1. A cord lock for a Venetian blind lift cord, comprising: a housing having a bottom wall for connection to a head channel of the Venetian blind, two side walls in spaced, substantially parallel relationship to each other and extending substantially perpendicularly to said bottom wall, each side wall being provided with an oblong window, said windows being in alignment with each other and extending at an acute angle with respect to said bottom wall, a cam extending in said housing through said windows and slidably received in said windows, each side wall also being provided with an elongated slot extending essentially vertically and at an angle with respect to said window, said slots being in alignment with each other, and a cord glide body non-rotatably but slidably mounted in said slots, said cord lock enabling a lift cord passed in said housing over said cord glide body and between said cord glide body and said cam to be releasably locked between said body and cam.

2. A cord lock according to claim 1, wherein said cord glide body has a central portion between said side walls, and two end portions respectively outside said side walls, said portions being separated by connecting portions respectively received within said slots.

3. A cord lock according to claim 2, wherein each of said end portions has at least one flattened side extending parallel to said elongated slots to prevent interference with the movement of said cam in said windows.

4. A cord lock according to claim 2, wherein each side wall is provided with an edge forming an extension of one of the sides defining the slot in the respective side wall, said edge serving to facilitate placement of the cord glide body into the slot.

5. A cord lock according to claim 4, wherein a notch is provided in each side wall at the junction of said edge with said side, said notch together with a corner formed at the end of the other side defining the slot forming a ledge for temporarily supporting said cord glide body prior to placement within said slot.

6. A cord lock according to any one of claims 1 to 5, wherein said cord glide body is a nickel-plated zinc die cast part.

* * * * *